US007288706B2

(12) United States Patent
Gaffga

(10) Patent No.: US 7,288,706 B2
(45) Date of Patent: Oct. 30, 2007

(54) STRINGED MUSICAL INSTRUMENT WITH MULTIPLE BRIDGE-SOUNDBOARD UNITS

(76) Inventor: Christopher Moore Gaffga, 104 Oakview Blvd., Lafayette, LA (US) 70503

( * ) Notice: Subject to any disclaimer, the term of this patent is extended or adjusted under 35 U.S.C. 154(b) by 29 days.

(21) Appl. No.: 11/321,471

(22) Filed: Dec. 29, 2005

(65) Prior Publication Data

US 2006/0150797 A1 Jul. 13, 2006

Related U.S. Application Data

(60) Provisional application No. 60/640,921, filed on Dec. 30, 2004.

(51) Int. Cl.
*G10D 3/00* (2006.01)

(52) U.S. Cl. ..... 84/291; 84/290; 84/184; 84/187; 84/192; 84/212; 84/267

(58) Field of Classification Search ..... 84/263, 84/267, 290, 291, 284, 295, 184, 187, 192, 84/212

See application file for complete search history.

(56) References Cited

U.S. PATENT DOCUMENTS 1,010,240 A * 11/1911 Degulio ..... 84/294
1,022,031 A * 4/1912 Larson ..... 84/263
1,183,369 A * 5/1916 Gardie ..... 84/263
1,188,983 A * 6/1916 Nonfri ..... 84/263
1,289,067 A * 12/1918 Ahachich ..... 84/263
1,472,991 A * 11/1923 Pribyl ..... 84/263
1,667,925 A * 5/1928 Brody ..... 84/325
1,684,467 A * 9/1928 Boothe ..... 84/263
1,697,396 A * 1/1929 Large ..... 84/263
1,723,751 A * 8/1929 Turturro ..... 84/263
1,726,311 A * 8/1929 Porter et al. ..... 84/263
1,773,133 A * 8/1930 Faccaro ..... 84/275
2,124,243 A * 7/1938 Carter et al. ..... 84/274
2,250,402 A * 7/1941 Towell ..... 84/263
D222,562 S * 11/1971 Pelenski ..... D17/14
D224,565 S * 8/1972 Pelenski ..... D17/15
D224,567 S * 8/1972 Pelenski ..... D17/14
D224,841 S * 9/1972 Dawson ..... D17/15
D229,096 S * 11/1973 Shacklett ..... D17/15
3,780,612 A * 12/1973 Robinson ..... 84/173
4,016,793 A 4/1977 Kasha
4,031,798 A 6/1977 Sidner
4,282,792 A * 8/1981 Voorthuyzen ..... 84/295
4,343,217 A * 8/1982 Brody ..... 84/743
4,377,101 A * 3/1983 Santucci ..... 84/743
4,622,877 A 11/1986 Strong
4,643,070 A 2/1987 Petrillo
4,782,732 A * 11/1988 Kato et al. ..... 84/313
4,903,567 A * 2/1990 Justus ..... 84/294
4,987,815 A * 1/1991 Shockley ..... 84/291
5,083,492 A 1/1992 Gorr
5,131,307 A * 7/1992 Castillo ..... 84/267

(Continued)

*Primary Examiner*—Lincoln Donovan
*Assistant Examiner*—Robert W. Horn

(57) ABSTRACT

A stringed musical instrument having multiple bridge-soundboard units, each unit substantially acoustically independent from other bridge-soundboard units. Said bridge soundboard units are coupled to a set of strings such that a number of the strings within the set are sounded through the first bridge-soundboard unit, others are sounded through a second bridge-soundboard unit, and so on. The process of division of set of strings among several bridge-soundboard units allows greater ability to bear tension, greater sustain, and greater variety of tonal color by allowing a greater number and variety of soundboards.

6 Claims, 9 Drawing Sheets

U.S. PATENT DOCUMENTS 5,212,329 A * 5/1993 Woodworth ..... 84/263
5,251,526 A 10/1993 Hill
5,315,910 A * 5/1994 Soupios ..... 84/453
5,469,770 A 11/1995 Taylor
5,497,688 A * 3/1996 Ruiz-Carrero ..... 84/291
5,571,980 A 11/1996 Busley
5,689,074 A 11/1997 Penridge
5,952,592 A 9/1999 Teel
6,107,552 A 8/2000 Coomar
6,121,537 A 9/2000 Pawar
6,166,308 A 12/2000 Lam
6,188,005 B1 2/2001 White
6,740,878 B2 5/2004 Dondiz
6,765,134 B2 * 7/2004 Bartz ..... 84/291
6,777,601 B1 8/2004 Kerfoot
7,102,073 B1 * 9/2006 Isola ..... 84/723
2003/0159562 A1 8/2003 Bailey
2003/0188622 A1 * 10/2003 Wilson ..... 84/267
2005/0188814 A1 9/2005 Bell
2006/0150797 A1 * 7/2006 Gaffga ..... 84/290

* cited by examiner

STRINGED MUSICAL INSTRUMENT WITH MULTIPLE BRIDGE-SOUNDBOARD UNITS

This application claims the benefit of U.S. provisional application No. 60/640,921 filed on 30 Dec. 2004.

DESCRIPTION OF THE INVENTION

1. Field of the Invention

The present invention is within the field of acoustic stringed instrument making 2. Description of the Prior Art Makers of stringed instruments have constantly sought to improve their instruments in a variety of dimensions, including pitch stability, acoustical quality, ability to sustain notes, volume of tones generated, and durability of the instrument.

Refinements in the construction of the instrument have led to the birth of new generations of instruments, each with some improvements in the qualities listed above. For example, better bracing systems, in part, allowed the development of the pianoforte from its predecessors, and the steel-string guitar from gut string instruments. These instruments project more volume, stay in tune more reliably, and last longer. Such changes allowed the instruments to assume different roles in ensembles, in essence to become different instruments. Bracing, shaping and carving of soundboards has led to further refinements of these basic designs.

Many of the basic problems in the field still remain, however. Instrument life is limited by the eventual deforming influences of the string tension on the soundboard. Many instruments, such as the harp, are limited in their ability to project sound. Other instruments sound well within a limited range, but suffer tonal impairments outside of the range to which they are most suited.

To address these problems, the concept of dividing or splitting the soundboard has been suggested. So also, some inventors have suggested dividing and splitting the bridge. But no improvement to date suggests doing both on the same instrument.

Many designs employ multiple soundboards, each one coupled to the same bridge, as example U.S. Pat. No. 4,343,217 issued to Brody and U.S. Pat. No. 4,377,101 issued to Santucci., U.S. Pat. No. 5,251,526 issued to Hill, and U.S. Patent application No. 2003/0159562. None of these designs employ a single set of strings which is divided in their attachment among several bridge-soundboard units.

U.S. Patent application 2005/0188814 by Bell, et al. also describes the separation of bridge and saddle units to effect a greater clarity and separation of the registers. However, that disclosure does not fully incorporate the bridge-soundboard units as described herein. Multiple soundboards are not enumerated, and the problems of reducing soundboard tension are addressed through bracing changes.

Another example of dual soundboard design is U.S. Pat. No. 6,107,552 issued to Coomar, et al. Two soundboards are sandwiched around a core composed of different material. This design clearly incorporates a single bridge to couple both soundboards to the strings.

U.S. Pat. No. 4,903,567 issued to Justus discloses an instrument which employs two sound chambers with a conventional bridge-soundboard unit.

Meyers (U.S. Pat. No. 5,293,804) discloses an invention in which all the strings in the set are coupled to two bridge-soundboard units. The essence of the invention disclosed herein is that some of the strings in the set are coupled to one bridge-soundboard unit, and other strings in the set are coupled to another bridge-soundboard unit.

Bartz (U.S. Pat. No. 6,765,134), Wilson (U.S. Patent Application 2003/0188622), Woodworth (U.S. Pat. No 5,212,329), Castillo (U.S. Pat. No. 5,131,307), Santucci (U.S. Pat. No. 4,377,101), Brody (U.S. Pat. No. 4,343,217) all teach an instrument comprised of multiple sets of strings, with no mention of dividing the strings of each set in its attachments to soundboards.

Ruiz-Carrero (U.S. Pat. No. 5,497,688) and Soupios (U.S. Pat. 5,315,910) disclose an instrument with multiple sets of strings, all attached to a single soundboard. Justus (U.S. Pat. No. 4,903,567) claims an instrument with a single set of strings, all attached conventionally to a standard soundboard. Kato (U.S. Pat. No. 4,782,732) teaches a single set of strings which is indeed divided in its attachment to the bridge as in the present invention. However, both tremelo components are anchored on the same soundboard.

Voorthuyzen (U.S. Pat. No. 4,282,79) teaches an instrument which redistributes the tension born by the soundboard by the addition of a second bridge. That instrument differs from the current invention in that all the strings are attached to both bridges, and both bridges are coupled to a single soundboard. Robinson (U.S. Pat. No. 3,780,61) describes an instrument with multiple sets of strings and multiple bridges, but a single soundboard. Oluwabusuyi (U.S. Pat. No. 7,102,073) teaches an instrument with two sets of strings, each mounted to an opposing face of the same instrument. In this invention, each set of strings is operationally coupled to a single side of the instrument.

U.S. Pat. No. 5,469,770 issued to Taylor discloses a soundboard system which distributes the tension of the strings among the two sides of a soundboard.

U.S. Pat. No. 4,016,793 issued to Kasha describes a bridge with greater mass on one side. This design is a step toward allowing different strings within the set to interact differently with the bridge and thereby the soundboard. However this differential interaction falls short of a complete separation of the bridge-soundboard units.

U.S. Pat. No. 5,952,592 issued to Teel discloses a design which emphasizes the bass and treble frequencies by employing separate bridge plates, not bridges. The treble bridge plate is rosewood and physically separate from the mahogany base plate. This design falls short of describing separate bridge soundboard units. A single soundboard is described.

U.S. Pat. No. 6,166,308 issued to Lam anticipates some aspects of the advantages of separately shaping and working the bass and treble sides of the instrument. That design describes bracing the treble and bass sides using different material.

Many improvements relate to the materials used to build the soundboard, as well as to bracing systems. Some of these, including U.S. Pat. No. 4,031,798 issued to Sidner, describe a soundboard design composed of multiple pieces and a single bridge. This design is clearly different than the design disclosed herein.

U.S. Pat. No. 4,782,732 issued to Kato, et al. discloses a split bridge tremolo device. No bridge-soundboard units are discussed as part of this invention.

U.S. Pat. No. 5,571,980 issued to Busley is illustrative of a subclass of musical instrument innovation that is primarily focused on increasing the ergonomic access of the player to the instrument's fretboards. It is worth noting that inventions along this line do not anticipate multiple bridge-soundboard units.

U.S. Pat. No. 5,689,074 issued to Penridge discloses a system which incorporates more vibration-generating units by means of a system of reeds coupled to the soundboard. This innovation is clearly different from the invention disclosed herein, which discloses multiple bridge-soundboard units.

U.S. Pat. No. 6,188,005 issued to White describes a musical instrument with a single bridge. The design disclosed by White is somewhat similar to the multicone resonator instruments. This bridge is coupled on one side to treble side soundboard component, and on the other to a bass side soundboard component. It is significantly different from the design disclosed in this application because it employs a single bridge.

U.S. Pat. No. 6,777,601 issued to Kerfoot anticipates some of the advantages of the present design, namely that a two—soundboard system can bear tension of the strings with less long-term wear on the instrument. Kerfoot describes a system where the single bridge is coupled to two soundboards.

U.S. Pat. No. 6,740,878 issued to Dondiz et al. describes a system for separating the tension-bearing component of the soundboard from the sounding component. Separate bridge-soundboard units are not described.

SUMMARY OF THE INVENTION

The present invention is directed toward a stringed musical instrument, whether bowed, plucked, hammered, strummed or otherwise sounded. The invention may be embodied as a piano, guitar, hammered dulcimer, violin, or other stringed instrument.

The instrument may have one set of strings or a plurality of sets of strings. Each set of strings is arranged so that it can be easily sounded by the player with a minimum of shifting of hands. The familiar arrangement of guitar strings on a conventional guitar illustrates many of the qualities of a set of strings; they are approximately parallel, positioned in the approximately the same plane, and spaced reasonably regularly.

In the present invention, a set of strings is divided in that some of the strings are attached to one bridge (which can be designated bridge A), which is coupled to a soundboard (soundboard A), thereby forming a bridge-soundboard unit (which can be designated bridge-soundboard unit A).

Within the same set of strings, other strings are coupled to another bridge-soundboard unit (which can be designated B). This division of strings with respect to their attachments can be continued as far as is reasonably prudent to achieve the benefits of this construction listed below. (i.e. Bridge-soundboard unit C, D, E, etc.)

Each bridge-soundboard unit is attached to the instrument at the sides. It may be braced or unbraced, radiused or unradiused, carved or not carved. A soundhole or soundholes may be employed, but are not required. The soundboards may be parallel to each other, in the same plane, or in skew planes.

Each bridge-soundboard unit enjoys a freedom of vibration because it moves without the direct contact of other such units. This arrangement reduces the possibility of interfering vibrations from other bridge-soundboard units.

The practice of lutherie over the past centuries has set forth a number of principles for the shaping of soundboards that can result in different acoustical responses. The present invention allows these aspects of the craft to utilized to a greater degree than previously possible. Improvements presented in the present invention are noted below.

Soundboards are noted to have points of greatest sympathy, or resonance. This point is frequency-specific, that is, with the pitch designated 128 Hertz, a certain portion of a piano soundboard has the greatest amplitude. For the pitch 512 Hz, a different portion moves with greatest amplitude. The present design takes advantage of this principle because, for a given bridge-soundboard unit, the bridge may be positioned on the soundboard to allow optimal excursion of the point of greatest sympathy. Thus, the character of bridge-soundboard unit A may emphasize relatively high pitches, and this bridge-soundboard unit would be coupled to the treble strings within a set of strings. The bass strings within a set of strings would be coupled with bridge-soundboard unit B, crafted to emphasize the bass frequencies.

Each instrument has a different color of sound, or timbre, in part because the soundboard has different fundamental frequency. This is illustrated by the qualitative difference in the same pitch sounded on a violin and a cello. The fundamental frequency varies with the material, surface area, thickness, as well as other factors. As with the point of greatest sympathy, the fundamental frequency can be exploited by the present invention. For each register of the instrument in the present invention, a different bridge-soundboard unit can be employed, with the resulting increase in clarity and volume.

One of the goals of piano building is giving the instrument a smooth tone color over its broad pitch range. A note struck on the piano is a complex mixture of the string vibrating at its fundamental frequency, and simultaneously vibrating at other frequencies called partials. This blending of partials is another contributor to the characteristic timbre of an instrument, and is largely dependent on the instrument soundboard. Following the example above, a bridge-soundboard unit that resonates with strong high partials might be chosen to couple to the treble strings within a set of strings. Within the same set of strings, a bridge-soundboard unit with other characteristics might be chosen for the bass strings.

Damping is the loss of overtones as the note dies away. The higher partials are dampened more slowly than the lower partials, due in part to the character of the soundboard, and also in part to the physical properties of the strings. As the string character changes from massy, wrapped long bass strings, struck by heavy soft hammers, to a thin, short strings struck by hard brisk hammers, the quality of tonal decay is changed. High strings have problems with sustain.

An example of the relationship between the strings and the soundboard is the behaviour of the bass strings. Bass strings often wrapped with copper wire to increase their mass without the resultant rod-like behavior of single-composition strings. Other, proportionately larger dimensions are employed, including length, larger striking hammers, greater velocity of strike, and others. Builders have expressed desire to increase the dimensions of the soundboard to take advantage of these properties. Conventional soundboards cannot accommodate this, and the result is a certain loss of higher partials, with a dark full resulting sound. The present invention would allow a proportionate bass soundboard, and improved bass sound.

To improve the sustain of the high notes, while retaining the richness of the complex partials in the bass register, in other words to make the instrument sound consistent across its range, many designs were employed. Tapered soundboards were industry standard for a time in pianos, until this became cost-prohibitive. The thicker ($3/8^{th}$ inch) treble side and thinner ($1/4^{th}$ inch) bass sides were based on the observation than in increase in density and rigidity of the wood led to a greater responsiveness at high frequencies.

Another advantage of separate bridge-soundboard units lies in the ability to make an instrument that will respond to a number of different playing styles. Light playing can be sounded best on a light soundboard, which does not require much energy to move. Heavy playing would likewise best be sounded on a more massive soundboard.

In addition to the improved acoustical qualities of the instrument detailed above, the design offers improved structural qualities. Simply put, the tension created by the strings is distributed across a greater number of soundboards.

The lifetime of a piano is largely limited by the tendency of the soundboard to deform. To resist the approximately thousand pounds of tension borne across the soundboard, many mechanisms are employed. The soundboard itself is built with an approximate 60-foot radius imparted by ribs glued into its underside. After the piano loses its so-called "crown," the volume and tonal quality of the instrument suffer. Guitar and mandolin soundboards tend to deform with age as well. The "bellying" of the soundboard behind the bridge creates intonation, action, and pitch problems.

The present design describes the several bridge soundboard units which together bear the load of the set of strings. This is an improvement compared with the conventional design where a single unit bears this weight.

Because the present design offers improved ability to bear tension, improvements in sustain are possible. The overall damping in the loudness of pitch $a^2$ on a concert grand is about 2.5 dB per second. The same note may dampen at more than 6 dB per second on an upright piano, the difference being largely due to the length of the string.

To allow longer strings requires ability to bear more tension. Following Mersenne's equations, the frequency of a string is proportional to the square root of its tension. The frequency is inversely proportional to its length, its diameter, and its linear density. If a designer can allow more tension in a string, then a greater string length and sustain can be achieved.

As will be apparent to a luthier, the basic invention may be realized in multiple instrument types and with different materials. Further, a variety of dimensions may be embodied by the invention, including scale length, number of strings, number of strings assigned to each bridge-soundboard unit, and other suitable modifications as would be obvious to one skilled in the art. Therefore, it is not desired to restrict the present invention to the embodiments employed here, but to extend the scope of the invention to modifications that would be appropriate and obvious to one skilled in the art.

DETAILED DESCRIPTION OF THE DRAWINGS

Figure 1:
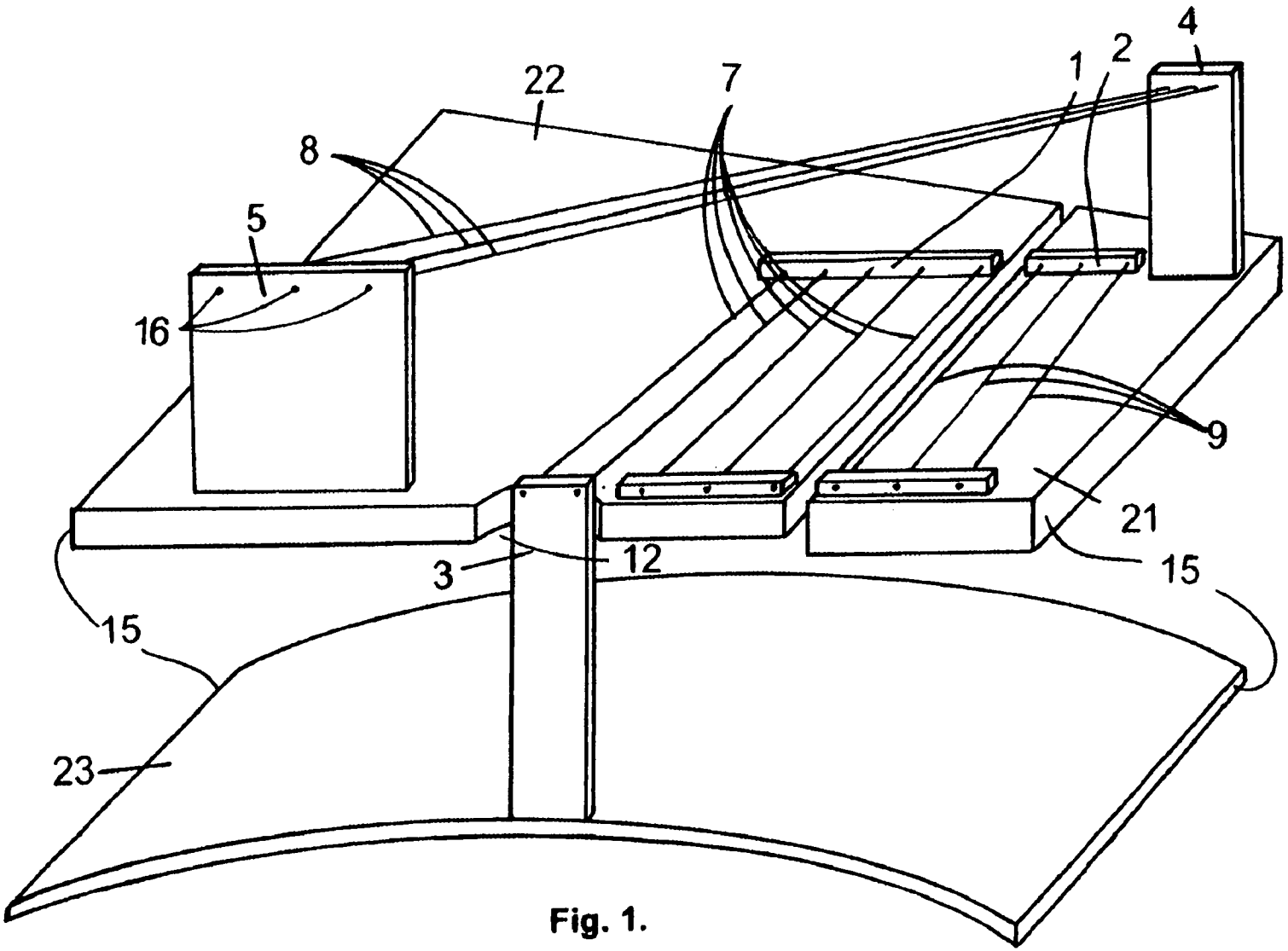
FIG. 1 is a perspective view of the invention embodied as a hand-held instrument meant to be struck with a hammer.

FIG. 1 is an embodiment of the instrument as a grouping of two sets of strings sounded by three soundboards. The first set of strings is sounded across three soundboards. The first set is composed of strings designated by 7 and 9. Their proximity allows them to be sounded at the same time, but some of the strings 9 are coupled to a thick soundboard 21, while other strings 7 are sounded across a thinner soundboard, and still others of the strings 7 are coupled to another, arched soundboard 23. Soundboards 22 and 21 are separated by a gap 12 and are mounted on separate bridge-soundboard units 1 and 2. Soundboard 23 is in another plane from the other soundboards, but roughly parallel to them. The distance between soundboard 23 and the first set of strings is covered by the height of the bridge 3 and by the fact that bridge 3 passes through a gap in soundboard 22. A second set of strings is strung between bridge 4 and 5, and this set is sounded by both soundboards 21 and 22. The soundboard is coupled at its edges 15 to the sides of a conventionally constructed instrument (not shown for clarity).

Figure 2A:
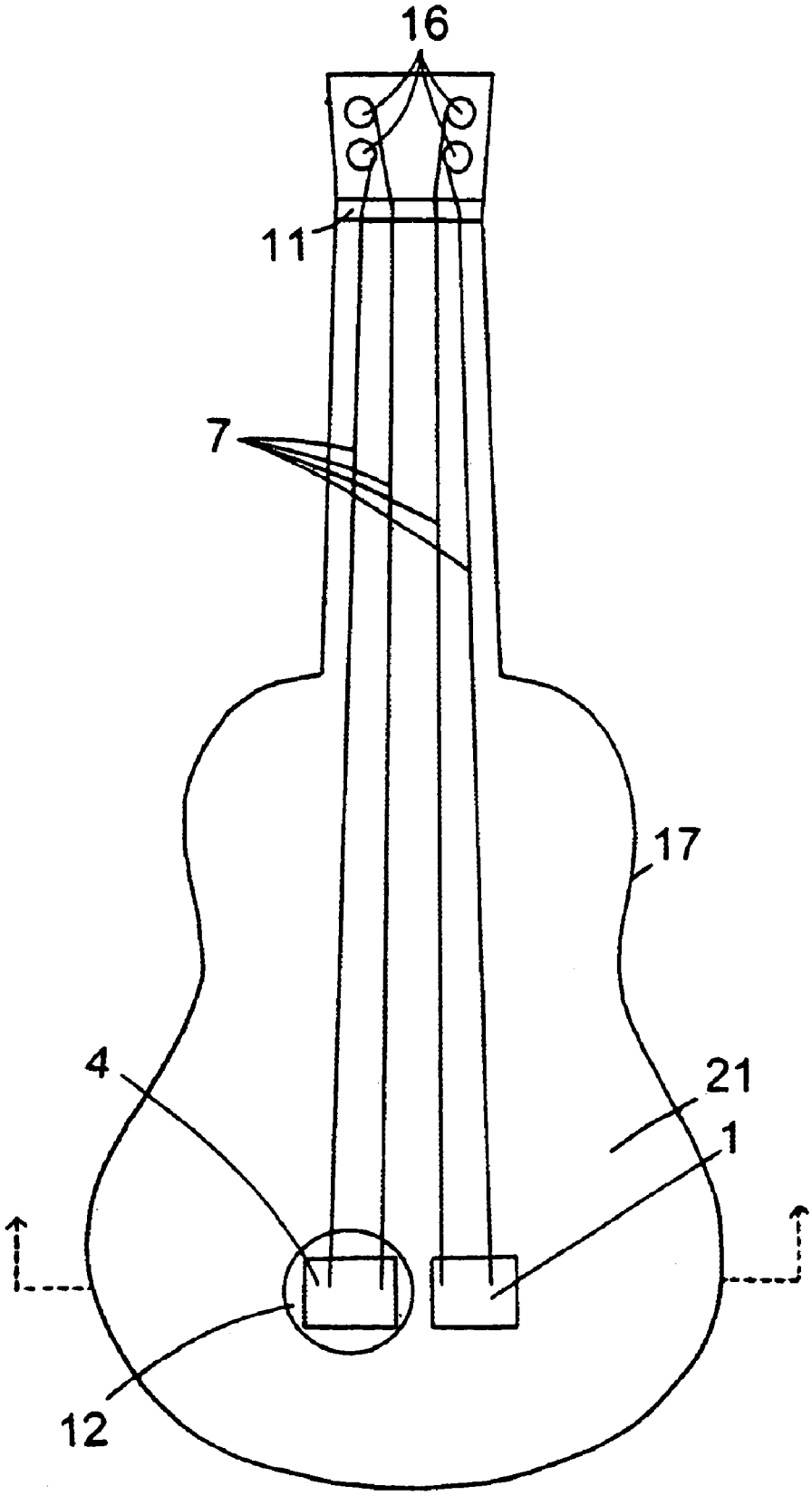
FIG. 2A is a perspective view of the invention embodied as a ukulele.

FIG. 2A shows a ukulele with two separate bridges. Bridge 1 is coupled to soundboard 21 and functions in a conventional manner. Bridge 4 passes through a hole 12 in the soundboard 21 without contacting soundboard 21. The set of strings 7 can be conveniently sounded by the player, setting into motion both bridge-soundboard units. Other elements, common to many stringed instruments, are illustrated.

Figure 2B:
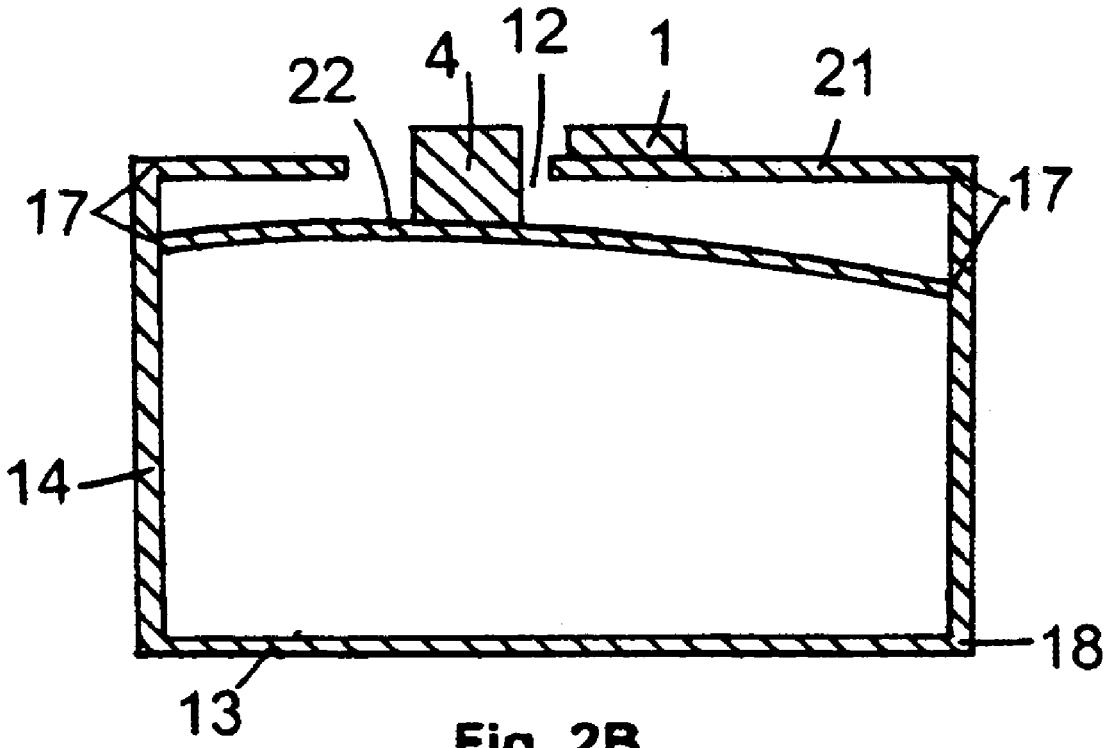
FIG. 2B is a cross-sectional view of the instrument of FIG. 2A.

FIG. 2B shows the cross-section of FIG. 2A, taken at the level indicated. Bridge 1 is coupled to soundboard 21 and functions in a conventional manner. Bridge 4 passes through a hole 12 in the soundboard 21 without contacting soundboard 21. Bridge 4 is coupled to soundboard 22. Both soundboards contact the sides of the instrument independently 17. By sounding the set of strings, two soundboards can be set in motion. Variable thickness of the soundboards is illustrated, adding a variety of tonal possibilities. Other elements, common to many stringed instruments, are illustrated.

Figure 3A:
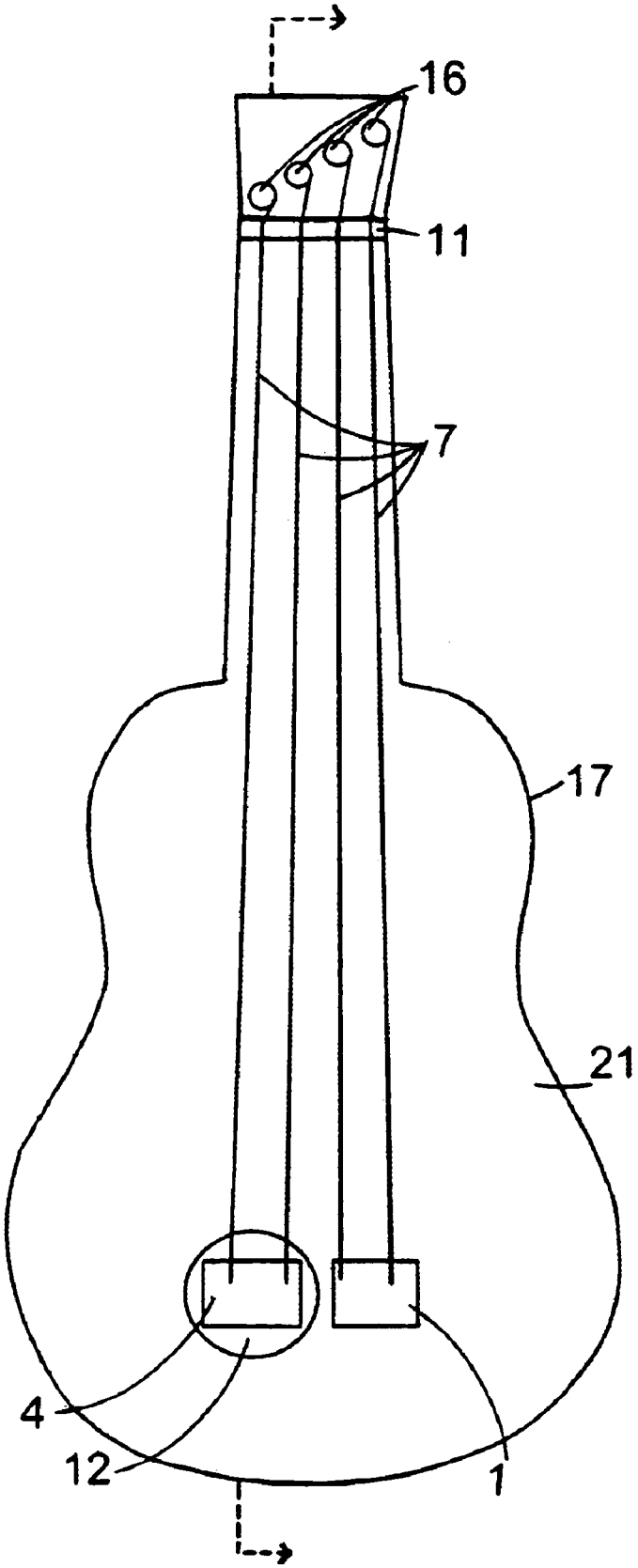
FIG. 3A is a perspective view of the invention embodied as a ukulele.

FIG. 3A shows a ukulele with two separate bridges. Bridge 1 is coupled to soundboard 21 and functions in a conventional manner. Bridge 4 passes through a hole 12 in the soundboard 21 without contacting soundboard 21. The set of strings 7 can be conveniently sounded by the player, setting into motion both soundboards. Other elements, common to many stringed instruments, are illustrated.

Figure 3B:
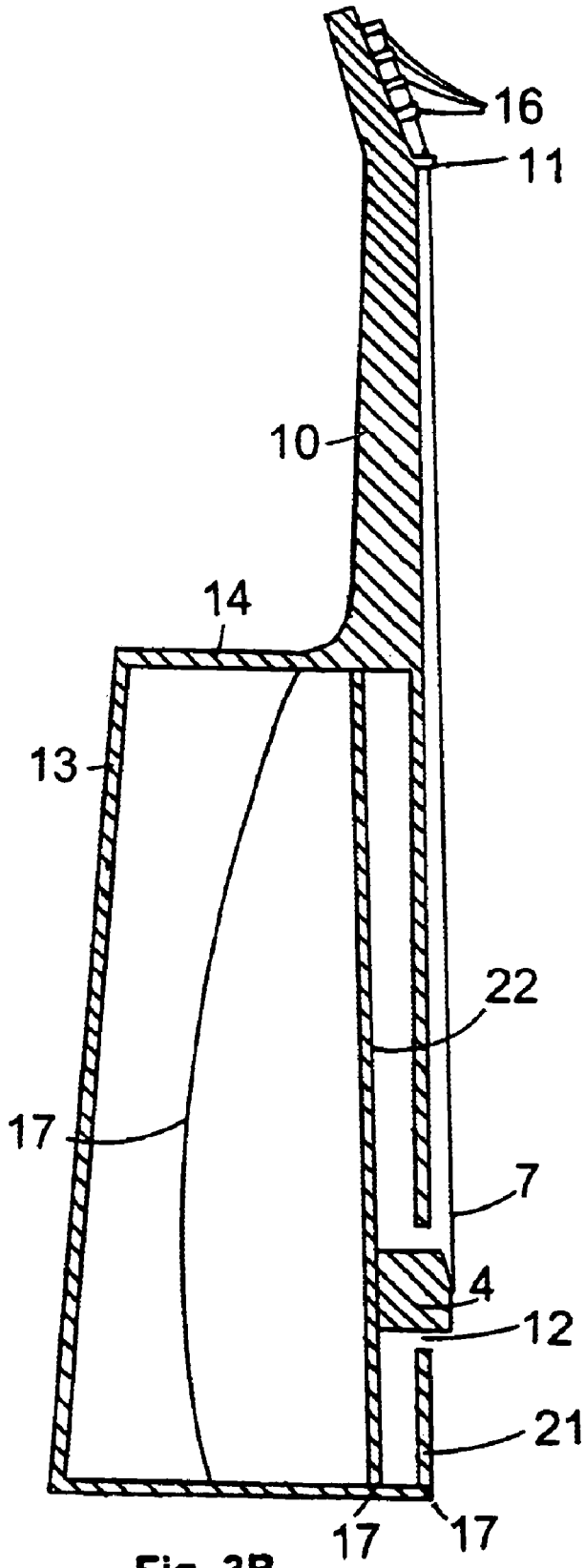
FIG. 3B is a cross-sectional view of the instrument of FIG. 3A.

FIG. 3B shows the cross-section of the instrument in FIG. 3A taken at the level indicated. Bridge 1 is coupled to soundboard 21 and functions in a conventional manner. Bridge 4 passes through a hole 12 in the soundboard 21 without contacting soundboard 21. Bridge 4 is coupled to soundboard 22. Both soundboards contact the back and sides of the instrument independently 17. By sounding the set of strings, two bridge-soundboard units can be set in motion. Variable thickness of the soundboards is illustrated, adding a variety of tonal possibilities. Other elements, common to many stringed instruments, are illustrated.

Figure 4A:
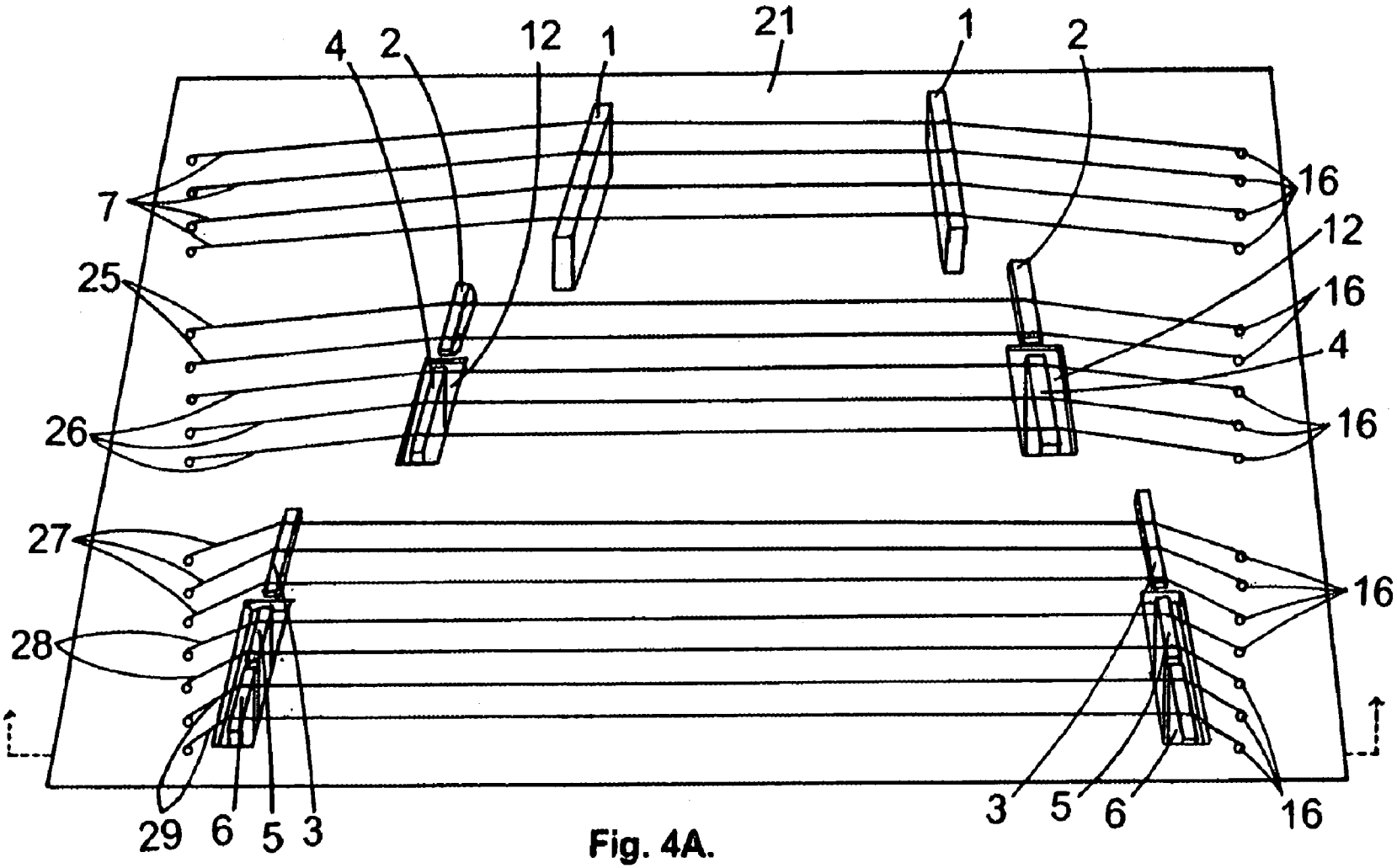
FIG. 4A is a perspective view of the invention embodied as a hammered dulcimer.

FIG. 4A shows the invention embodied as a hammered dulcimer. Only the top soundboard 21 can be seen, although other soundboards are present as referred to in the cross-section drawing below. The first set of strings 7 is braced across soundboard 21. The second set, comprised of strings denoted 25 and 26 are strung across bridges 2 and 4 to activate soundboard 21 and another soundboard shown in the cross-sectional figure below. Bridge 4 passes through the soundboard 21 via a gap labeled 12. The third set of strings is composed of strings denoted 27, 28 and 29. This third set is strung across bridges 3, 5, and 6. Sounding the third set of strings sets into motion the bridge-soundboard unit composed of bridge 3 and soundboard 21, as well as the bridge-soundboard unit composed of bridge 5 and a soundboard not visible, and also sets into motion the bridge-soundboard unit composed of bridge 6 and a soundboard not in view. Bridges 5 and 6 pass through the soundboard 21 without contacting soundboard 21. Other elements, common to many stringed instruments, are illustrated.

Figure 4B:
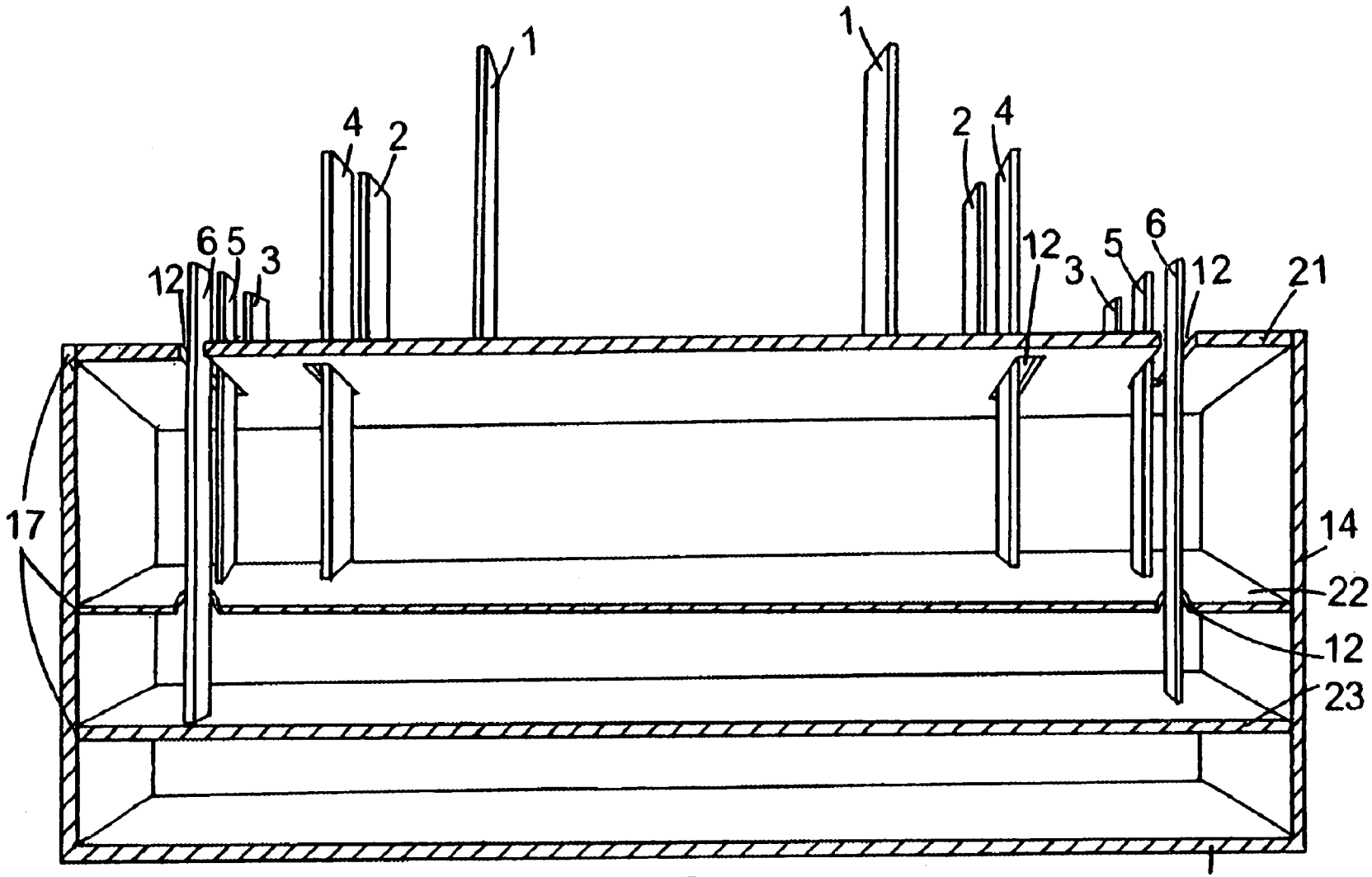
FIG. 4B is a cross-sectional view of the instrument of FIG. 4A.

FIG. 4B shows a cross-section view of the instrument in FIG. 4A. End pins and strings are omitted for clarity. The three soundboards 21, 22, and 23 are illustrated. The first set of strings 7 is coupled only to one soundboard 21 by bridge 1. The second set of strings passes over the next-highest pair of bridges 2 and 4. This second set of strings is coupled to soundboard 21 via bridge 2 and to soundboard 22 via bridge 4. The third set of strings is suspended from bridges 3, 5, and 6. This third set of strings is coupled to soundboard 21 through bridge 3, to soundboard 22 through bridge 5, and to soundboard 23 through bridge 6. Variable thickness of the soundboards is illustrated, adding a variety of tonal possibilities. No contact is made between any of the bridges or soundboards, other than the coupling denoted above. Separate attachment of the soundboards to the sides of the instrument is shown 17.

Figure 5A:
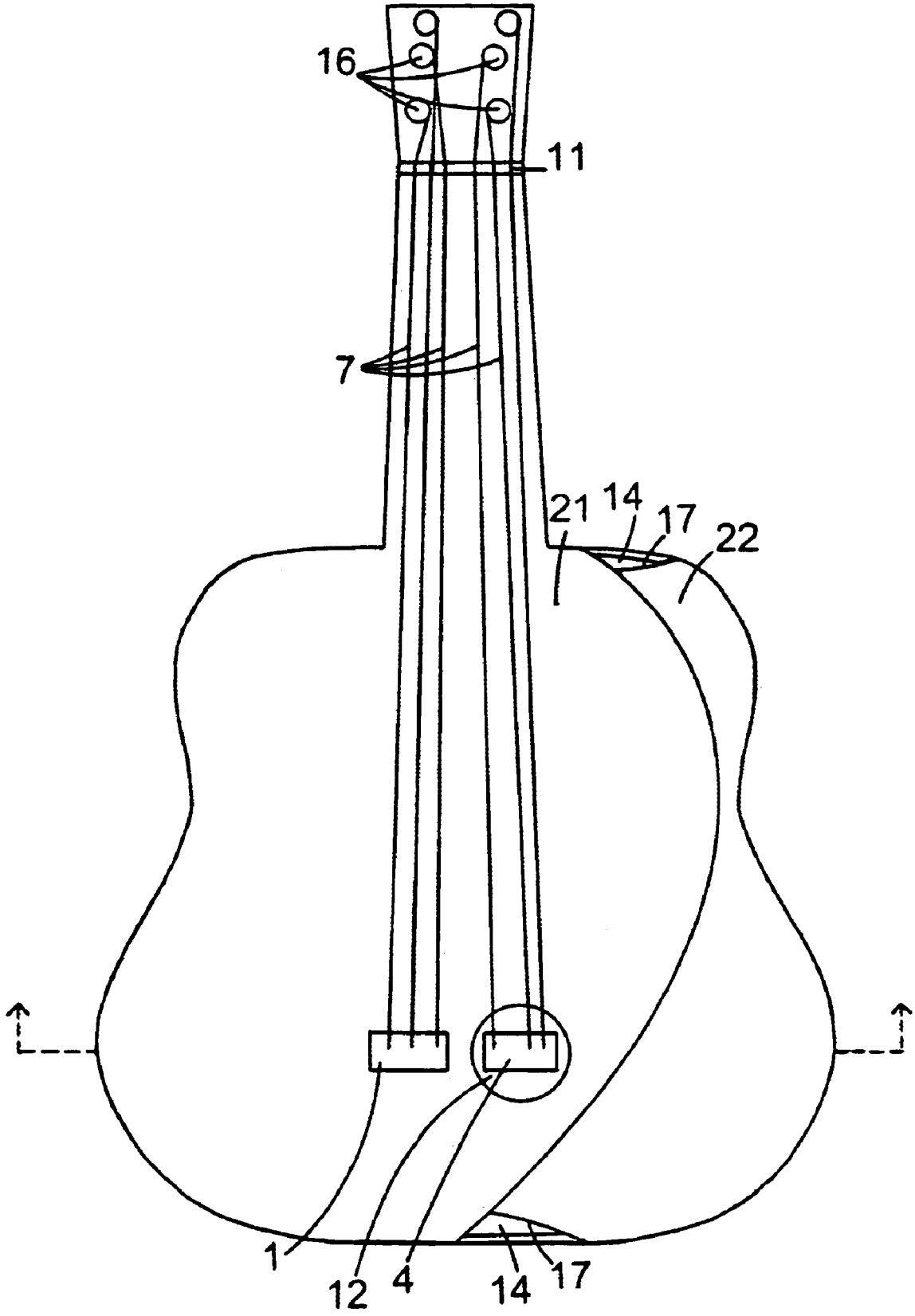
FIG. 5A is a perspective view of the invention embodied as a guitar.

FIG. 5A shows the invention embodied as a guitar in a perspective view. Three of the set of strings is coupled to the bridge-soundboard unit formed by bridge 1 and soundboard 21. The other three strings are coupled to the bridge-soundboard unit formed by bridge 4 and soundboard 22. Bridge 4 passes cleanly through soundboard 21 through the gap labeled 12. A partial view of soundboard 22 can be seen as it curves from its lateral side attachment to the instrument, down deep to soundboard 21. The sides of the instrument are visible from the front view, as is the junction 17 between the soundboard 22 and the sides 14.

Figure 5B:
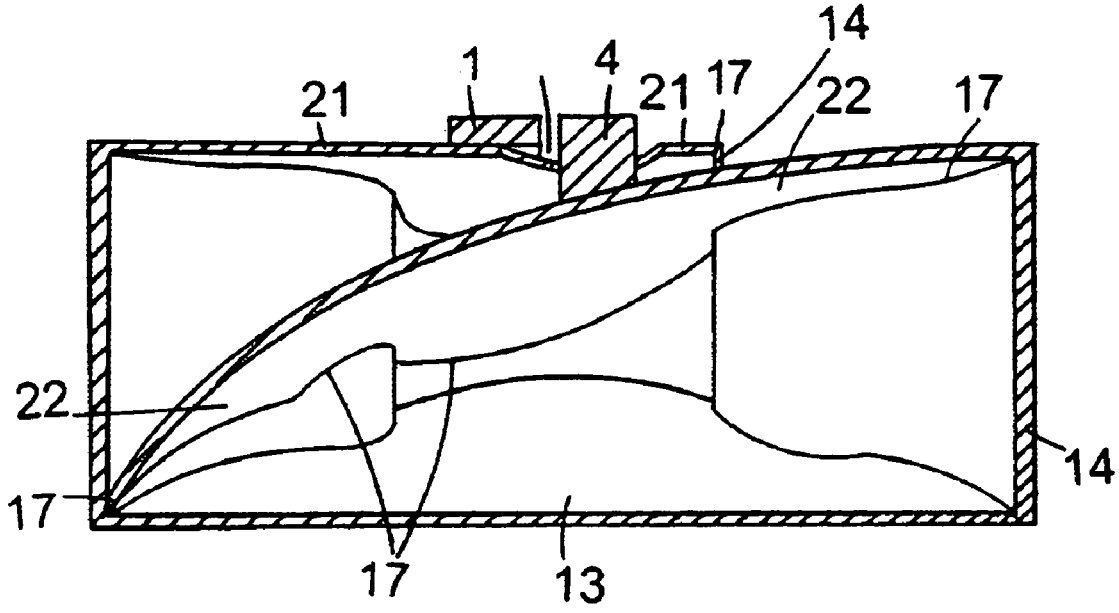
FIG. 5B is a cross-sectional view of the instrument of FIG. 5A.

FIG. 5B is a cross-sectional view of the instrument of FIG. 5A. The set of strings is not directly visible in this sectional view, but the set is couples to bridges 1 and 4. The set of strings is coupled to soundboard 21 via bridge 1. The set is also coupled to soundboard 22 via bridge 4. Bridge 4 passes cleanly through soundboard 21 via the gap labeled 12. The curvature of soundboard 22 can be clearly seen, as can its contact with the sides of the instrument 17. Variable thickness of the soundboards is illustrated, adding a variety of tonal possibilities. Other elements, common to many stringed instruments are illustrated.

While the invention is described in several embodiments above, the scope of the invention includes the application of the concepts listed in the description above which any person reasonably skilled in the art of stringed instrument making could envision.

REFERENCE NUMERALS

1. Bridge A
2. Bridge B
3. Bridge C
4. Bridge D
5. Bridge E
6. Bridge F
7. Grouping of strings A
8. Grouping of strings B
9. Grouping of strings C
10. Grouping of strings D
11. Nut
12. Space between soundboards
13. Back of instrument
14. Sides of instrument
15. Free edge of soundboard, potentially connected to side of instrument
16. End pins
17. Junction of soundboard and instrument body
18. Junction of back and sides of instrument
21. Soundboard A
22. Soundboard B
23. Soundboard C
25. Grouping of strings D
26. Grouping of strings E
27. Grouping of strings F
28. Grouping of strings G
29. Grouping of strings H

What is claimed is:

1. A stringed musical instrument with a single set of a plurality of strings where said set of strings is divided in its attachment to the instrument such that some members of the set of strings are coupled to a unit comprised of a conventional bridge and soundboard, while other members of the set are attached to other conventional bridge-soundboard units, with no direct contact between said units.

2. The stringed musical instrument of claim 1 wherein substantial freedom from interefering vibration is achieved by constructing the instrument such that there is no direct contact between the said bridge-soundboard units.

3. The stringed musical instrument of claim 2 wherein each said bridge-soundboard unit contacts another part of the instrument such as the sides, back or neck, independently from the other bridge-soundboard units.

4. The stringed musical instrument of claim 1 wherein said set of strings is considered to be a plurality of strings easily sounded by the player, arranged in approximately parallel fashion, in approximately the same plane, with approximately similar spacing between adjacent strings in the group.

5. The stringed musical instrument of claim 1 wherein each of said bridge-soundboard units is crafted with different mass and stiffness which thereby evoke a particular character of musical timbre from the strings coupled to said bridge-soundboard unit, such that the player may evoke a greater variety of musical expression from the set of strings.

6. A method for constructing a stringed instrument, comprising a. Constructing a stringed instrument according to well-established methods of lutherie or piano-making, save for the modification of a bridge that mounts fewer than the number of strings that will be present on the final instrument;

b. constructing a second soundboard that is coupled to a second bridge in a configuration that allows a significantly greater distance between the strings and the soundboard than was allowed in the original construction in the above step;

c. cutting a hole in the original soundboard of the instrument of sufficient size to allow a second bridge connected to a second soundboard to project through the original soundboard;

d. aligning the bridges of the units constructed in the first two steps so that the set of strings in the final instrument are easily sounded by the player and are arranged in an approximately parallel fashion, are in approximately the same plane, and have approximately similar spacing between adjacent strings in the set;

e. mounting the second soundboard in this position in the instrument in such a way that there is no direct contact between the first bridge-soundboard unit and the second bridge-soundboard unit;

f. repeating the above steps so that an entire set of strings is thereby mounted by installing a number of bridge-soundboard units, each bridge-soundboard unit having no direct contact with other bridge soundboard units.

* * * * *